United States Patent [19]

Pagliaccio

[11] Patent Number: 4,660,855

[45] Date of Patent: Apr. 28, 1987

[54] COMPUTER PAPER INDEX TAB

[76] Inventor: Joseph A. Pagliaccio, 207 Bayville Ave., Bayville, N.Y. 11709

[21] Appl. No.: 797,647

[22] Filed: Nov. 13, 1985

[51] Int. Cl.[4] ..... B42D 1/00; B42F 13/00; B42F 21/00

[52] U.S. Cl. ..... 281/2; 402/79; 402/500; 40/359

[58] Field of Search ..... 283/3, 2, 35, 36; 40/360, 359, 11 R, 23 R; D19/99; 24/67 R, 67 P, 67.7, 67.9; 402/79, 500; 281/2, 5, 78

[56] References Cited

U.S. PATENT DOCUMENTS

| | | | |
|---|---|---|---|
| D. 240,622 | 7/1976 | Thornton . | |
| D. 250,623 | 4/1980 | Plecko . | |
| D. 261,354 | 10/1981 | Clemens . | |
| 998,646 | 7/1911 | Simons | 402/79 |
| 2,357,070 | 8/1944 | Bates | 40/359 |
| 2,623,311 | 12/1952 | Condon | 40/359 |
| 3,269,391 | 8/1966 | Wagner | 40/359 |
| 3,540,140 | 11/1970 | Tourre | 40/23 A |
| 4,201,403 | 5/1980 | Turner . | |
| 4,285,146 | 8/1981 | Charles et al. | 283/2 |

*Primary Examiner*—Paul A. Bell
*Assistant Examiner*—Paul M. Heyrana, Sr.
*Attorney, Agent, or Firm*—Daniel Jay Tick

[57] ABSTRACT

An index tab for use in conjunction with computer paper includes a female jaw and a male jaw pivotally attached along a common edge such that they are movable between an open position and a closed position wherein projections from the male jaw extend through perforations along the margin of the computer paper and frictionally engage registered apertures in the female jaw. A tab section is attached to and extends from the common edge and extends outwardly from the margin of the computer paper.

4 Claims, 5 Drawing Figures

COMPUTER PAPER INDEX TAB

BACKGROUND OF THE INVENTION

This invention relates to index tabs and more particularly to index tabs for use in conjunction with computer paper having a perforated margin.

Index tabs have long been used to aid in identifying and locating frequently used pages or sections of multipage files or reports. Known index tabs are generally permanently affixed to a specific page or sheet and are not adapted to be removed and reused.

Computer reports often are generated on a regular periodic basis and provide up-dated information concerning the same subject matter such as product sales or inventory. When a new report is available, the superceded report is often discarded together with the permanently affixed index tabs. This procedure is wasteful of both material and time to prepare and attach new tabs.

Those concerned with these and other problems recognize the need for an improved index tab for computer paper.

BRIEF SUMMARY OF THE INVENTION

The present invention provides an index tab for use in conjunction with computer paper. The index tab includes a female jaw and a male jaw pivotally attached along a common edge such that they are movable between an open position and a closed position wherein projections from the male jaw extend through the perforations along the margin of the computer paper and frictionally engage registered apertures in the female jaw. A tab section is attached to and extends outwardly from the margin of the computer paper.

The tab section may either be imprinted to display specific information or the tab section may be formed of transparent material and include a slot to receive a printed label. The index tab may be conveniently attached through the marginal perforations in standard computer paper, and may be easily removed and reused.

An object of the present invention is the provision of an improved index tab.

Another object is to provide an index tab that is convenient to use.

A further object of the invention is the provision of an index tab that is simple in design and inexpensive to manufacture.

Still another object is to provide an index tab that is adapted for use in conjunction with standard computer paper.

A still further object of the present invention is the provision of an index tab that may be conveniently relocated and reused.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF PREFERRED EMBODIMENT

Figure 1:
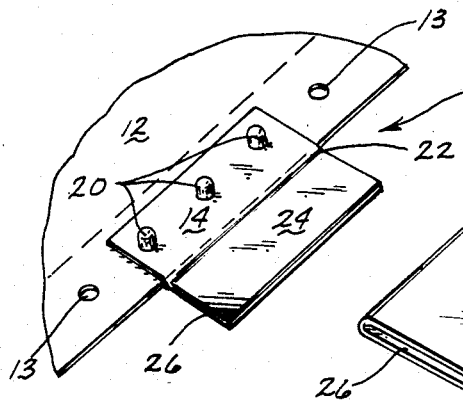
FIG. 1 is a perspective view of the index tab of the present invention attached to the perforated margin of a sheet of standard computer paper.
Figure 2:
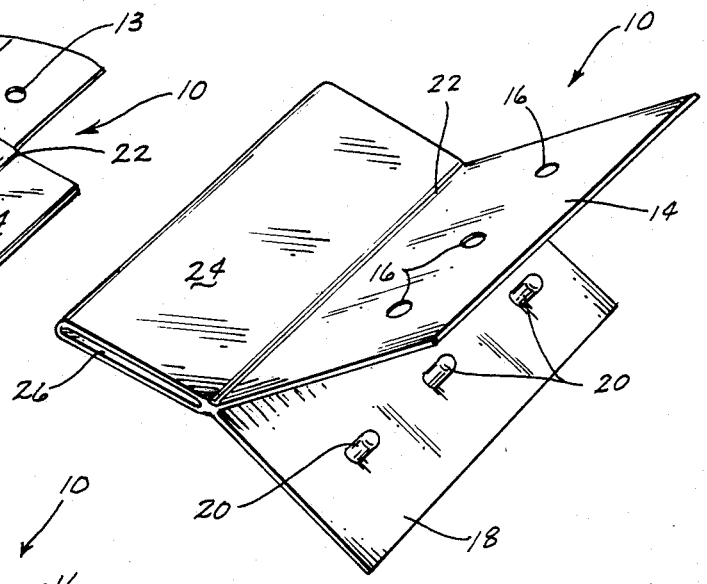
FIG. 2 is an enlarged perspective view of the index tab shown in the open position.

Referring now to the drawings, wherein like reference numerals designate identical or corresponding parts throughout the several views, FIG. 1 shows the index tab (10) of the present invention secured to the margin of a sheet of standard computer paper (12). The index tab (10) includes a female jaw (14) having regularly spaced apertures (16) formed therein, and a male jaw (18) having regularly spaced projections (20) extending therefrom (FIG. 2). The female and male jaws (14 and 18) are pivotally attached along a common edge (22) such that they are selectively movable between an open position (FIG. 2) and a closed position (FIGS. 1, 3 and) wherein the projections (20) extend through and frictionally engage the registered apertures (16). A tab section (24) is attached to the common edge (22) and extends outwardly therefrom beyond the edge of the computer paper (12). A slot (26) is formed in the tab section (24) and is disposed to receive a printed label (not shown) which is visible through the transparent material forming said tab section. It is to be understood that identifying indicia could also be imprinted directly on the outer surface of the tab section (24).

Figure 3:
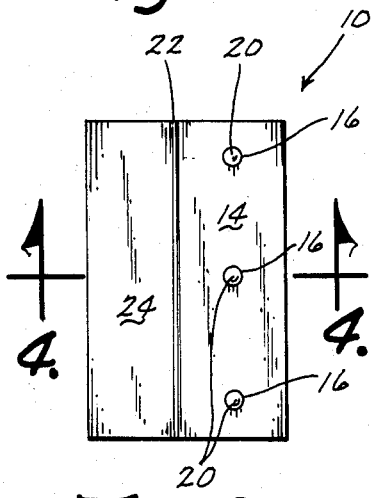
FIG. 3 is a top plan view thereof.
Figure 4:
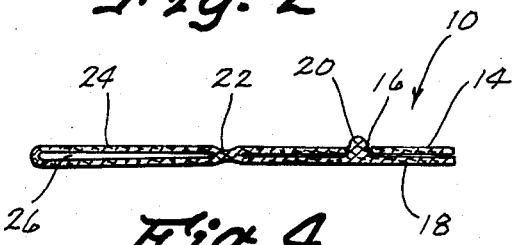
FIG. 4 is a sectional view, taken along the lines 4—4 of FIG. 3 showing the index tab in the closed position.
Figure 5:
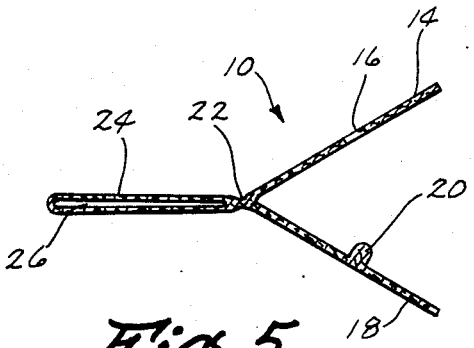
FIG. 5 is a sectional view similar to FIG. 4, but showing the index tab in the open position.

In use, the index tab (10) is positioned adjacent the margin of the computer paper (12) and the projections (20) are inserted through the regularly spaced perforations (13) of the paper (12) (FIG. 1) and into the apertures (16) of the female jaw (12) by frictional engagement of said projections within said apertures (FIGS. 1, 3 and 4). When it is desired to remove and relocate the index tab (10), the jaws (14 and 18) are simply separated and the index tab (10) is removed and reattached at another location.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. An index tab in combination with sheet material having regularly spaced perforations along its margin, the perforations being spaced apart a predetermined distance, said index tab comprising a female jaw including regularly spaced apertures said apertures being spaced apart by said predetermined distance and being registrable with said perforations in the margin of said sheet material;

a male jaw including regularly spaced projections registrable with said apertures, said male jaw being pivotally attached to said female jaw along a common edge, said male and female jaws being selectively movable between an open position and a closed position wherein said projections extend through and frictionally engage said apertures and said jaws also being movable from the closed position to the open position whereby said index tab maybe removably affixed to the sheet material with the sheet material between said jaws at selected ones of the sheet perforations; and a tab section attached to said male and female jaws at said common edge and extending outwardly therefrom and having a slot formed therein disposed to receive a label.

2. The index tab of claim 1 wherein said tab section is formed of transparent material.

3. The index tab of claim 1 wherein said index tab is integrally formed.

4. The index tab of claim 1 wherein said index tab is formed of transparent material.

* * * * *